United States Patent [19]

Yunoki et al.

[11] Patent Number: 4,606,100

[45] Date of Patent: Aug. 19, 1986

[54] ELEMENT GUIDE IN APPARATUS FOR MANUFACTURING SLIDE FASTENERS WITH FLIES

[75] Inventors: Akio Yunoki, Namerikawa; Tatsuo Osaki, Uozu; Masaaki Fuda, Kurobe, all of Japan

[73] Assignee: Yoshida Kogyo K. K., Tokyo, Japan

[21] Appl. No.: 662,358

[22] Filed: Oct. 18, 1984

[30] Foreign Application Priority Data

Oct. 18, 1983 [JP] Japan ..... 58-194496

[51] Int. Cl.[4] ..... B21D 53/52

[52] U.S. Cl. ..... 29/33.2; 29/408; 29/767; 29/768

[58] Field of Search ..... 29/408, 409, 410, 766, 29/767, 768, 770

[56] References Cited

U.S. PATENT DOCUMENTS

| | | | |
|---|---|---|---|
| 3,626,579 | 12/1971 | Maeda | 29/408 |
| 4,190,944 | 3/1980 | Yoshida et al. | 29/408 |
| 4,236,292 | 12/1980 | Orr et al. | 29/408 |
| 4,443,923 | 4/1984 | Takahashi | 29/410 X |
| 4,495,686 | 1/1985 | Fisher et al. | 29/409 |
| 4,520,544 | 6/1985 | Morita et al. | 29/408 |

*Primary Examiner*—Gil Weidenfeld
*Assistant Examiner*—Glenn L. Webb
*Attorney, Agent, or Firm*—Hill, Van Santen, Steadman & Simpson

[57] ABSTRACT

An apparatus automatically manufactures a succession of slide fasteners with flies from a continuous slide fastener chain having a pair of intermeshed rows of coupling elements with element-free spaces therein and stringer tapes supporting the rows of coupling elements, respectively, with the flies sewn to one of the tapes. The apparatus includes a feed path along which the chain can be fed, a feed roller assembly for feeding the chain along the feed path in selective engagement with the intermeshed rows of coupling elements, and an element guide operatively coupled with the feed roller assembly for guiding the rows of coupling elements along the feed path across the feed roller assembly. The feed roller assembly comprises a driven roller and an idling roller movable toward and away from the driven roller for feeding the chain along the feed path. The element guide has guide legs disposed upstream and downstream of the feed roller assembly and having guide grooves, respectively, aligned with the feed path. The element guide is angularly movable and is normally urged into an angular position to cause one of the guide legs to guide the rows of coupling elements in the guide groove therein while allowing the mounted slider to move past the other guide leg.

3 Claims, 10 Drawing Figures

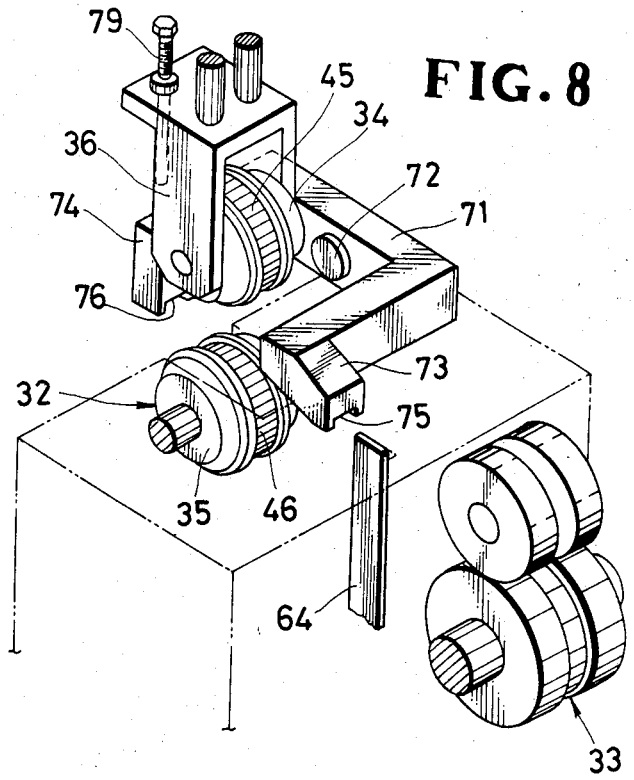
FIG. 8
FIG. 9
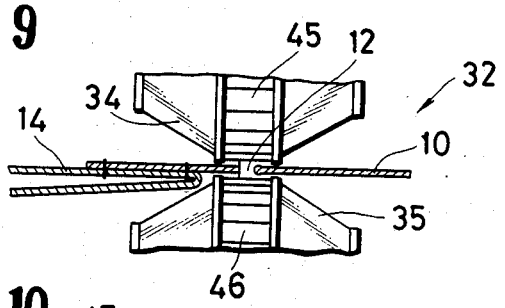
FIG. 10
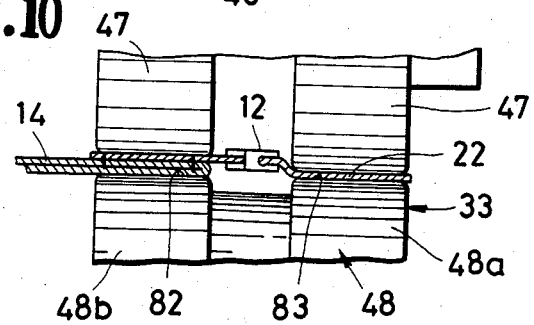

ELEMENT GUIDE IN APPARATUS FOR MANUFACTURING SLIDE FASTENERS WITH FLIES

BACKGROUND OF THE INVENTION

1. Field of the Invention

The present invention relates to an element guide in an apparatus for automatically manufacturing a succession of slide fasteners with flies sewn thereto.

2. Description of the Prior Art

Various apparatus have been put to use for automatically manufacturing slide fasteners successively. However, no apparatus has been proposed or employed in the art for automatically manufacturing slide fasteners with flies attached thereto.

It has been customary practice to use slide fasteners with flies stitched thereto in advance for increased efficiency when slide fasteners are to be attached to a closing at the front of men's trousers. The fly is sewn to one of the stringer tapes longitudinally along a transversely substantially central line, the fly being wider than the slide fastener. At the time of such sewing on the slide fastener, the fly is folded on itself about the stitching and then sewn to the trousers. In the production of slide fasteners with flies, if a fly were to be attached to a finished slide fastener, then difficulty would arise in sewing the fly to the slide fastener on a sewing machine due to the presence of a slider on the slide fastener. Therefore, it is more advantageous to sew flies to a slide fastener chain in advance, and then to process the slide fastener chain into individual finished slide fasteners. However, since flies have already been sewn to the slide fastener chain, the fly has to be folded on itself before a slider is mounted on the chain, and the folded fly presents an increased thickness on one side of the chain, which has prevented the chain from being accurately fed along. The folded fly attached to one of stringer tapes renders the tapes different in rigidity, making it less reliable to thread the tape edges through the slider. For accurately feeding the chain, it would be possible to drive the chain with a feed roller assembly engaging the row of coupling elements only. However, the slider would interfere with the feed roller assembly. For the reasons described above, only manually operated apparatus have been available in the past for manufacturing slide fasteners with flies.

SUMMARY OF THE INVENTION

It is an object of the present invention to provide an element guide in an apparatus for automatically manufacturing a succession of slide fasteners with flies from a slide fastener chain with such flies sewn thereto in advance.

According to the present invention, there is provided an apparatus for automatically manufacturing a succession of slide fasteners with flies from a continuous slide fastener chain having a pair of intermeshed rows of coupling elements with element-free spaces therein and stringer tapes supporting the rows of coupling elements, respectively, with the flies sewn to one of the tapes, which apparatus comprises a feed path along which the chain can be fed, a feed roller assembly for feeding the chain along the feed path in selective engagement with the intermeshed rows of coupling elements, and an element guide operatively coupled with the feed roller assembly for guiding the rows of coupling elements along the feed path across the feed roller assembly. The feed roller assembly comprises a driven roller and an idling roller movable toward and away from the driven roller for feeding the chain along the feed path. The element guide has guide legs disposed upstream and downstream of the feed roller assembly and have guide grooves, respectively, aligned with the feed path. The element guide is angularly movable and normally urged into an angular position to cause one of the guide legs to guide the rows of coupling elements in the guide groove therein while allowing the mounted slider to move past the other guide leg.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 8 is a perspective view of the chain guide device;

FIG. 9 is a front elevational view of a feed roller assembly; and

FIG. 10 is a fragmentary front elevational view of a discharge roller assembly as it discharges a slide fastener chain.

DETAILED DESCRIPTION

Figure 1:
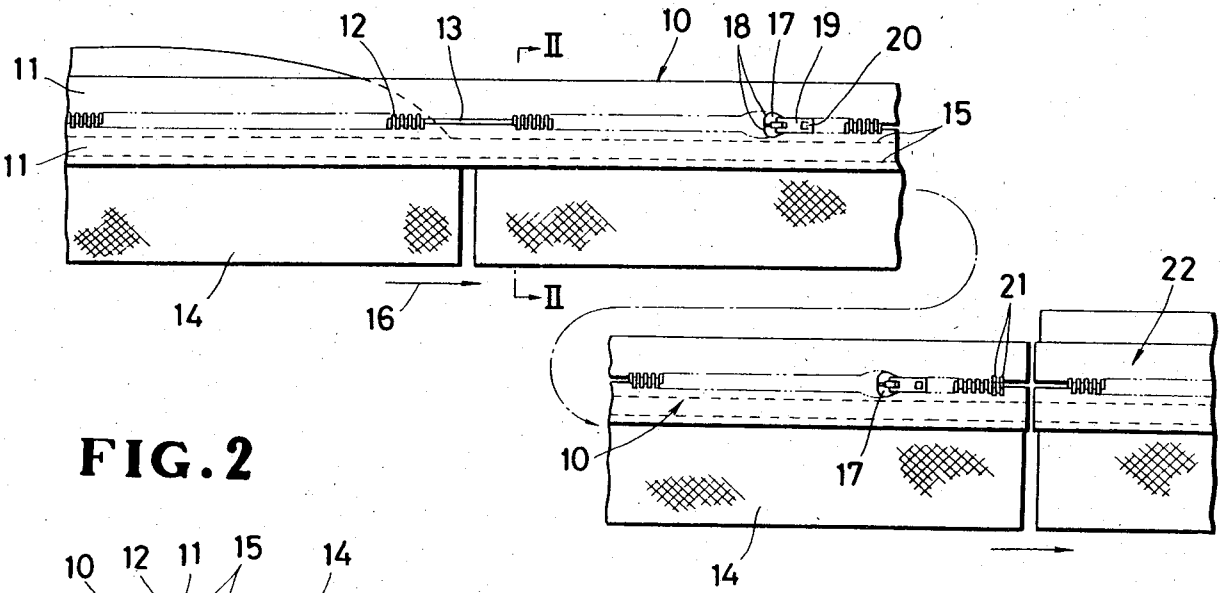
FIG. 1 is a plan view showing the progressive process in which a slide fastener with a fly is manufactured.
Figure 2:
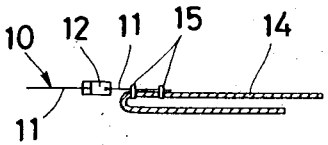
FIG. 2 is a cross-sectional view taken along line II —II of FIG. 1.

As shown in FIGS. 1 and 2, a slide fastener chain 10 is composed of a pair of continuous stringer tapes 11, 11 supporting intermeshed rows of discrete coupling elements 12 on confronting longitudinal edges thereof with an element-free space or gap 13 in the intermeshed rows of coupling elements 12. A fly 14 wider than the chain 10 is sewn to one of the stringer tapes 11 by two rows of sewing threads 15 along a transversely substantially central portion of the fly 14. The chain 10 with the stitched fly 14 is progressively processed as follows:

As the chain 10 travels in the direction of the arrow 16, the fly 14 is folded on itself about the sewing threads 15, as shown in FIG. 2, thus exposing the intermeshed rows of coupling elements 12. A slider 17 is put in the element-free space 13 as the intermeshed rows of coupling elements 12 is threaded through the slider 17 from its open shoulders 18, 18. The slider 17 has a pull tab 19 with a through-hole 20 defined therein. Then, bottom stops 21 are applied to an end of the intermeshed rows of coupling elements 12, and the chain 10 is cut into a predetermined length, thereby completing a slide fastener 22 with the fly 14.

Figure 3:
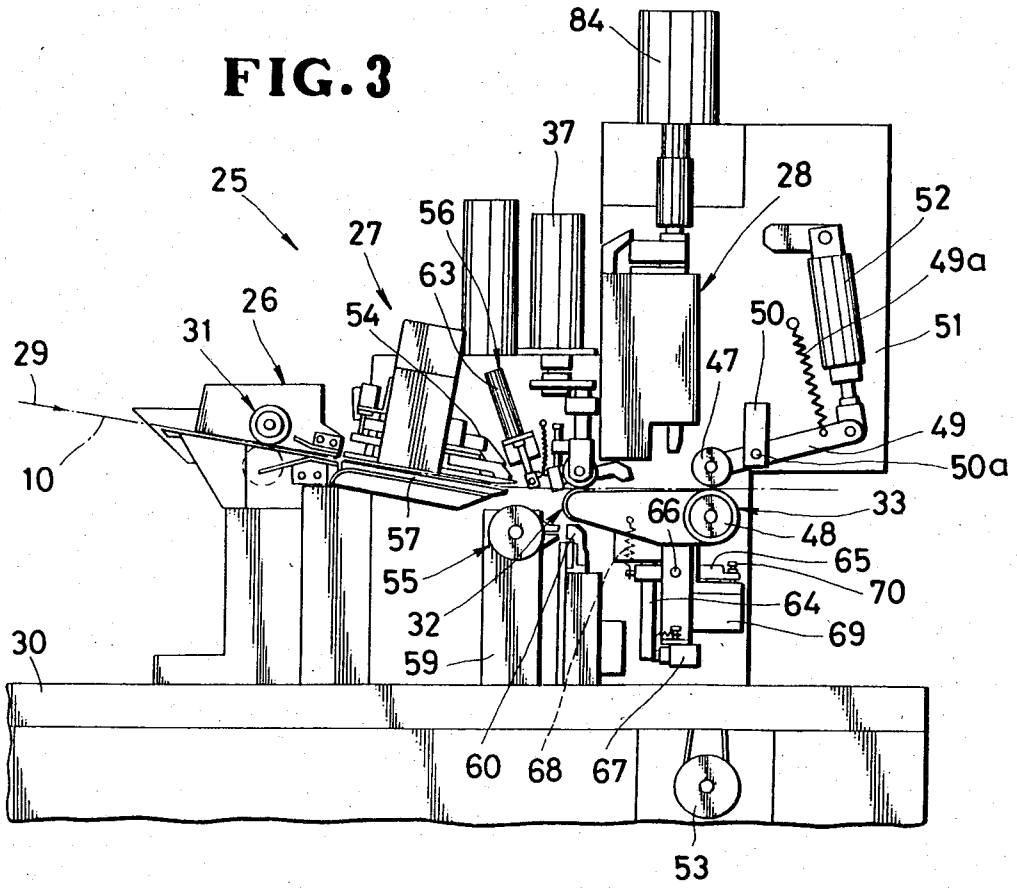
FIG. 3 is a side elevational view of an apparatus for manufacturing slide fasteners with flies.
Figure 4:
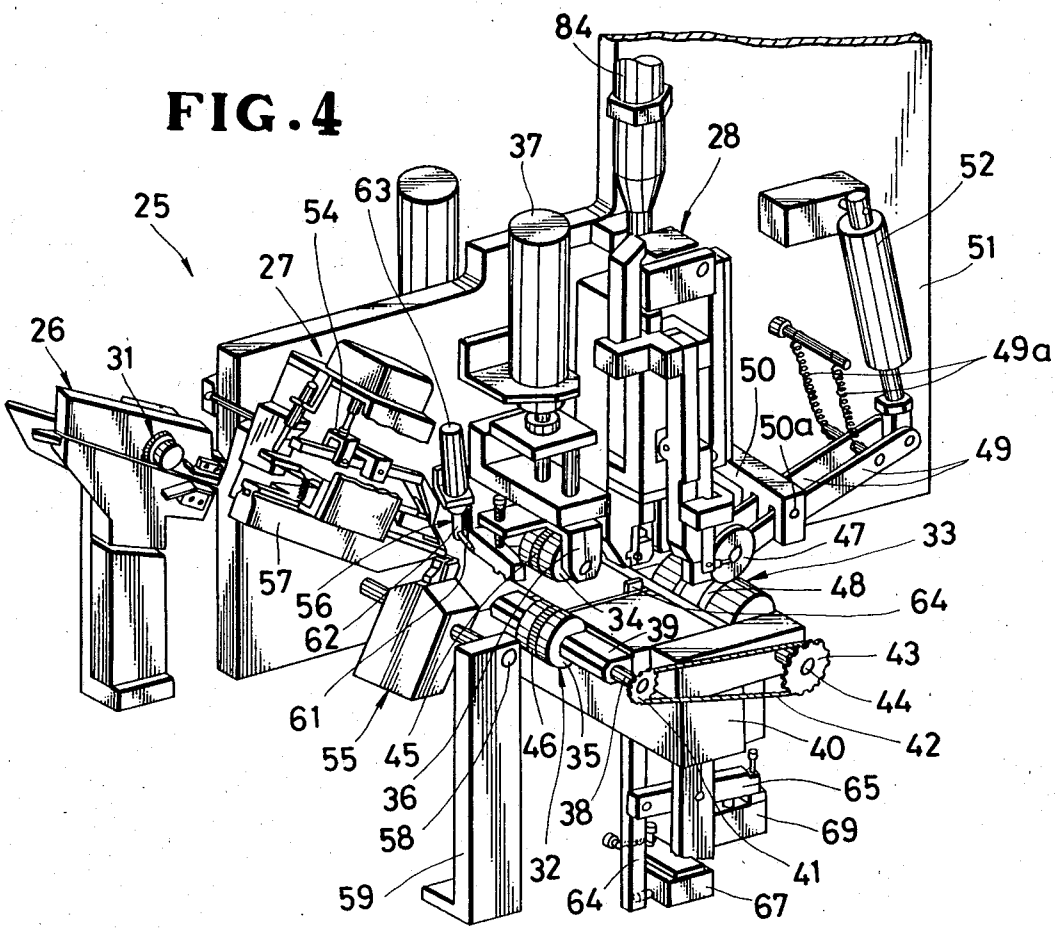
FIG. 4 is a fragmentary perspective view of the apparatus shown in FIG. 3.

The slide fastener chain 10 with the fly 14 can be processed into the slider fastener 22 with the fly 14 by an apparatus generally designated by the reference numeral 25 in FIGS. 3 and 4. The apparatus 25 essentially comprises a fly folder 26, a slider applicator 27, and a bottom stop applicator and chain cutter 28, which are arranged in the order named along a feed path 29 for the slide fastener chain 10 and mounted on a bed or base 30.

The feed path 29 is primarily defined by a guide roller assembly 31 in the fly folder 26, a feed roller assembly 32 disposed downstream of the slider applicator 27, and a discharge roller assembly 33 disposed downstream of the bottom stop applicator and chain cutter 28.

As the chain 10 is fed along through the guide roller assembly 31, the fly 14 starts being progressively folded by an inclined guide plate (not shown) before reaching the guide roller assembly 31 and is folded completely on itself after moving past the guide roller assembly 31.

As shown in FIGS. 3 and 4, the feed roller assembly 32 comprises a pair of upper and lower rollers 34, 35 for feeding the intermeshed rows of coupling elements 12 therebetween. The upper roller 34 is rotatably mounted on a bracket 36 (FIG. 4) which is movable vertically by a first fluid cylinder 37 to bring the upper roller 34 toward and away from the lower roller 35. The lower roller 35 is rotatably mounted by a shaft 38 in a bearing 39 mounted on a block 40. The shaft 38 supports on an end thereof a sprocket 41 which is driven via an endless chain 42 by a sprocket 43 mounted on an end of a shaft 44 of the discharge roller assembly 33. As shown in FIGS. 4 and 9, the upper and lower rollers 34, 35 have toothed or otherwise roughened peripheral surfaces 45, 46, respectively, for engaging and driving the intermeshed rows of coupling elements 12.

As shown in FIGS. 3 and 4, the discharge roller assembly 33 is composed of a pair of laterally spaced upper rollers 47, 47 and a lower roller 48 coacting with the upper rollers 47, 47 for discharging a completed slide fastener in sandwiching relation. Each of the upper rollers 47, 47 is rotatably mounted on one end of a lever 49 pivotably connected by a pin 50*a* to a bracket 50 mounted on a vertical mount plate 51. The other end of the lever 49 is pivotably connected to a piston rod of a second fluid cylinder 52 supported on the vertical mount plate 51. Thus, the levers 49, 49 are pivotably movable to bring the respective upper rollers 47, 47 into and out of engagement with the lower roller 48, in response to operation of the second fluid cylinder 52. The upper rollers 47, 47 are normally urged against the lower roller 48 by means of a pair of tension coil springs 49*a*, 49*a* acting between the respective levers 49, 49 and the vertical mount plate 51. The levers 49, 49 are loosely connected to the piston rod of the cylinder 52 such that the levers 49, 49 are pivotally movable against the bias of the respective springs 49*a*, 49*a* when the chain 10 is passed between the upper and lower rollers 47, 48. As illustrated in FIGS. 3 and 4, the lower roller 48 is supported on the shaft 44 which is rotatably supported on the vertical mount plate 51 and driven to rotate by a motor 53 mounted in the bed 30.

As shown in FIGS. 3 and 4, the slider applicator 27 is composed of the feed path 29, a chain splitter 54, a slider supply unit 55, and a tape edge inserter 56. The chain splitter 54 is mounted on the vertical mount plate 51 and has a chain guide 57 inclined along the feed path 29 progressively downwardly in the direction in which the chain 10 is fed. The slider supply unit 55 is disposed below the downstream end of the chain splitter 54 and is angularly movably supported on a horizontal shaft 58 mounted on a post 59 vertically disposed on the bed 30. Sliders 17 are successively delivered from a chute 60 (FIG. 3) to the slider supply unit 55. The tape edge inserter 56 is disposed above the feed path 29 between the chain splitter 54 and the feed roller assembly 32, as shown in FIG. 3. The tape edge inserter 56 comprises a substantially horizontal rod 61 secured to a piston rod 62 (FIG. 4) of a third fluid cylinder 63 mounted on the mount plate 51. The horizontal rod 61 extends substantially perpendicularly to the feed path 29, and is movable downwardly by the third fluid cylinder 63 for depressing engagement with the chain 10.

Figure 5:
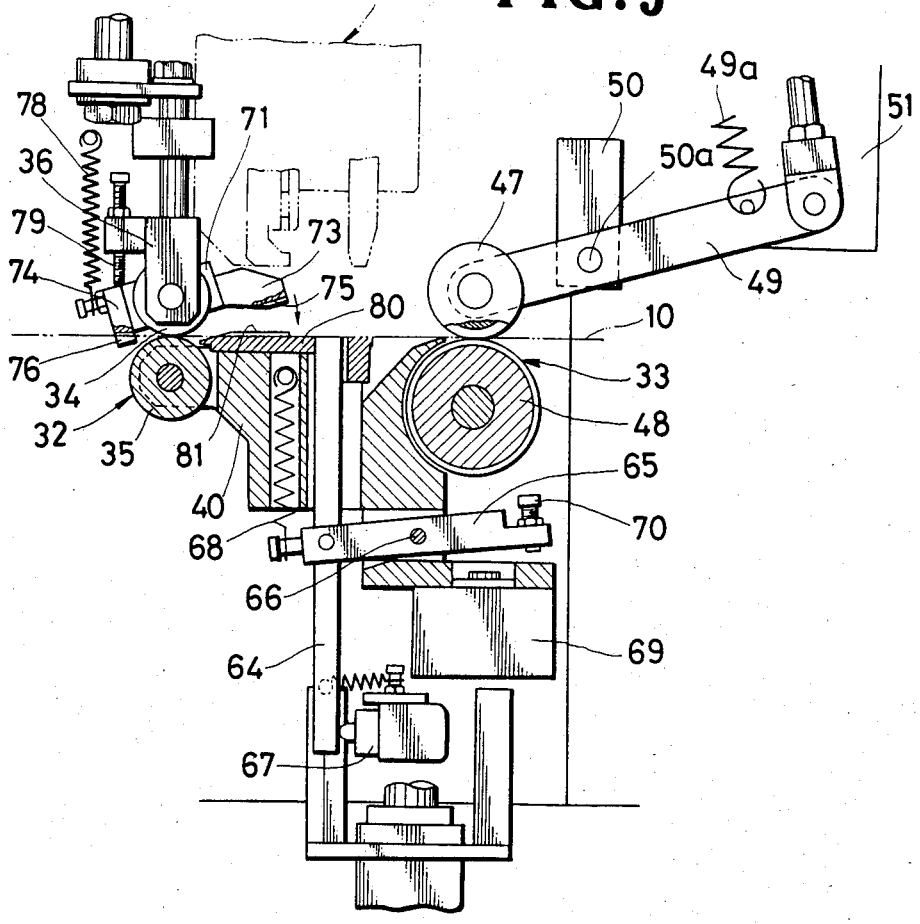
FIG. 5 is a side elevational view, partly in cross section, of a chain guide device in the apparatus shown in FIG. 3.
Figure 6:
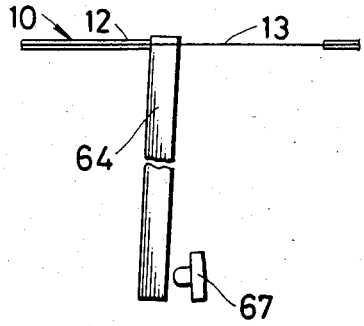
FIG. 6 is a side elevational view of a stopper as it stops a slide fastener chain.
Figure 7:
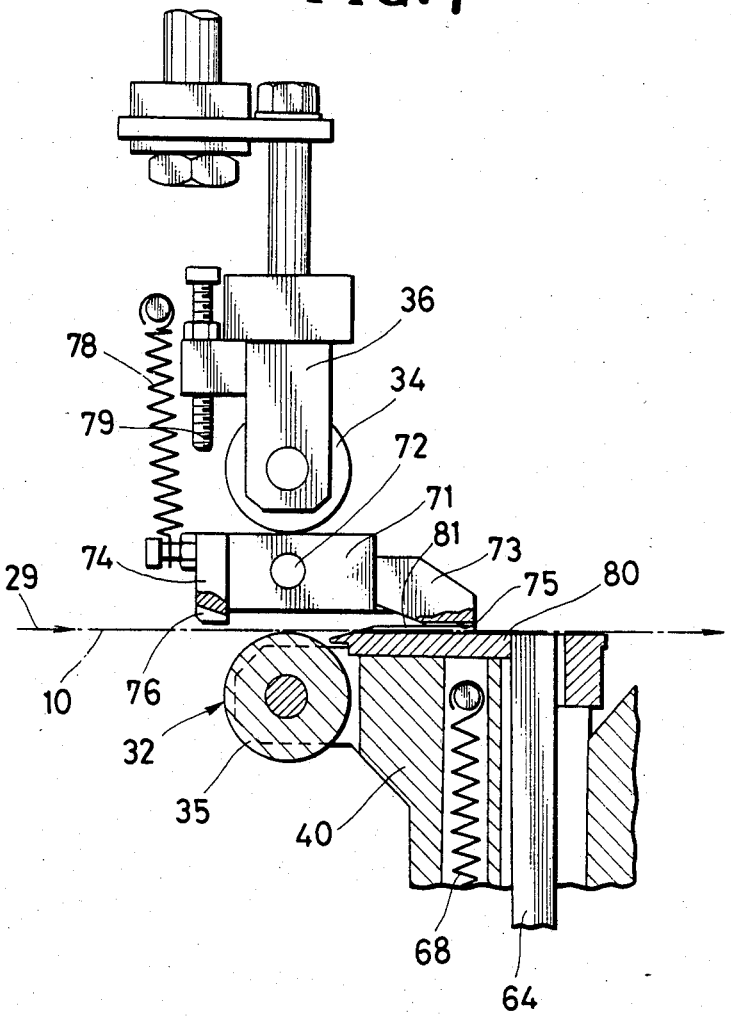
FIG. 7 is a side elevational view, partly in cross section, of the chain guide device.

As shown in FIG. 5, a vertical stop bar 64 is angularly movably mounted on an end of a lever 65 pivotably mounted by a pin 66 on the mount plate 51. The stop bar 64 has an upper end normally slidably held against a lower surface of the intermeshed rows of coupling elements 12, and a lower end normally engaging a sensor 67. When an element-free space 13 in the chain 10 reaches the upper end of the stop bar 64, the stop bar 64 is moved upwardly under the bias of a spring 68 acting on the lever 65 for projection into the space 13. The upper end of the stop bar 64 becomes slightly displaced in a downstream direction due to the movement of the chain 10, whereupon the lower end of the stop bar 64 disengages from the sensor 67 which issues a signal to de-energize the motor 53. A fourth fluid cylinder 69 is mounted on the mount plate 51 for acting on the lever 65 to lower the stop bar 64 out of the space 13 when the chain 10 is to be fed along again. The lever 65 has an adjustment bolt 70 for adjusting the interval which the stop bar 64 is vertically movable.

As illustrated in FIGS. 5 to 8, there is a substantially U-shaped element guide 71 pivotably mounted on a shaft 72 and including front and rear guide legs 73, 74 disposed forward and rearward, respectively, of the feed roller assembly 32. The front and rear guide legs 73, 74 have guide grooves 75, 76, respectively, opening downwardly and aligned with the feed path 29. The element guide 71 is normally urged to turn clockwise (FIGS. 5 and 7) about the shaft 72 under the bias of a spring 78 acting on a rear end of the element guide 71. The bracket 36 on which the upper feed roller 34 is rotatably mounted has a vertical bolt 79 vertically aligned with the rear guide leg 74 for depressing the rear guide leg 74 when the upper feed roller 34 is lowered. When the upper feed roller 34 is raised by the first fluid cylinder 37 (FIG. 3), the element guide 71 is turned clockwise under the resiliency of the spring 78 to cause the rear guide leg 74 to be lifted and the front guide leg 73 to be lowered. The bracket 40 on which the lower feed roller 35 is rotatably mounted has an upper element guide base 80 with an upwardly opening guide groove 81 aligned with the feed path 29. When the front guide leg 73 of the element guide 71 is lowered, the guide groove 75 in the front guide leg 73 and the guide groove 81 in the element guide base 80 jointly define a guide slot (FIG. 7) for guiding the intermeshed rows of coupling elements 12 therethrough.

As shown in FIG. 10, the lower discharge roller 48 has a pair of axially spaced roller portions 48*a*, 48*b* of equal diameters which are vertically aligned with the upper rollers 47, 47, respectively. Since the levers 49, 49 are connected pivotably and loosely connected to the piston rod of the cylinder 52, the upper rollers 47, 47 are vertically movably away from the respective roller portions 48*a*, 48*b* of the lower roller 48 so as to define a gap 82 between one of the upper rollers 47 and the lower portion 48*b* which is greater than a gap 83 between the other upper roller 47 and the lower portion 48a. The wider gap 82 allows the folded fly 14 of the slider fastener 22 to smoothly pass between the upper roller 47 and the lower roller portion 48*b*.

Operation of the apparatus thus constructed is as follows: The slide fastener chain 10 with the fly 14 stitched thereto is fed along the feed path 29 first into the fly folder 26 in which the fly 14 is folded on itself while the chain 10 is guided by the guide roller assembly 31. The chain 10 is driven through the chain splitter 54 by the feed roller assembly 32. At this time, a slider 17 is disposed on the slider supply unit 55 with the open shoulders 18 opening upwardly. The slider 17 is securely retained in place by a locking prong (not shown) engaging in the pull tab hole 20. The chain 10 is stopped to open the space 13 and split open the leading end of the rows of coupling elements 12. The slider supply unit 55 is turned to position the slider 17 in the space 13. The confronting inner edges of the stringer tapes 11, 11 are now inserted into the slider 17 through side slots therein. To enable the tape edges to be reliably inserted into the slider 17, the rod 61 of the tape edge inserter 56 is lowered to depress the chain 10 so that the tape edges which may have engaged an upper slider surface will enter the slider 17. During this time, the upper feed roller 34 is lowered to sandwich the chain 10 between the upper and lower feed rollers 34, 35, and the upper and lower discharge rollers 47, 48 sandwich the chain 10 therebetween. Because the rear guide leg 74 of the element guide 71 is lowered, the rows of coupling elements 12 are smoothly guided by the guide groove 76, as shown in FIG. 5.

The lower discharge roller 48 is turned through a certain angular interval, and the lower feed roller 35 is also turned by the chain 42 in synchronism with the lower discharge roller 48. The chain 10 is advanced slightly to cause the rows of coupling elements 12 to enter the slider 17 through the open shoulders 18, 18, respectively, whereupon the slider 17 is placed on the rows of coupling elements 12. Then, a bottom stop is applied and the chain 10 is cut off by the bottom stop applicator and chain cutter 28 in response to actuation of a fifth fluid cylinder 84. The upper feed and discharge rollers 34, 47 are now lowered. A severed slide fastener is then discharged by the discharge roller assembly 33. The chain 10 is also fed along by the feed roller assembly 32, during which time the front guide leg 73 is in the upper position allowing the slider 17 to go toward the discharge roller assembly 33.

During operation of the apparatus, the element guide 71 can accurately guide the rows of coupling elements 12 at all times alternately with the guide legs 74, 73 while allowing the slider 17 to pass therethrough. The discharge roller assembly 33 can discharge the completed slide fastener 22 reliably without causing any jam since the fly 14 can smoothly move through the wider gap 82 between upper roller 47 and the lower roller portion 48*b*.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An apparatus for automatically manufacturing a succession of slide fasteners with flies from a continuous slide fastener chain having a pair of intermeshed rows of coupling elements with element-free spaces therein and stringer tapes supporting the rows of coupling elements, respectively, with the flies sewn to one of the tapes, comprising:

(a) a feed path along which the chain can be fed;

(b) first means in said feed path for folding one of the flies on itself at a time;

(c) second means in said feed path for mounting sliders one at a time on the rows of coupling elements;

(d) a feed roller assembly for feeding the chain along said feed path in selective engagement with the intermeshed rows of coupling elements;

(e) third means in said feed path for applying a bottom stop to the rows of coupling elements and cutting off the chain across one of the element-free spaces to produce a slide fastener with a fly;

(f) a discharge roller assembly actuatable in synchronism with said feed roller assembly for discharging the produced slide fastener with the fly;

(g) said feed roller assembly comprising a driven roller rotatable in synchronism with said discharge roller assembly, a fluid cylinder, and an idling roller coacting with said driven roller for feeding the chain along said feed path, said idling roller being movable by said fluid cylinder toward and away from said driven roller;

(h) means operatively coupled with said feed roller assembly for guiding the rows of coupling elements along said feed path across said feed roller assembly, said guiding means comprising an angularly movable element guide having guide legs disposed upstream and downstream of said feed roller assembly in said feed path, said guide legs having guide grooves, respectively, aligned with said feed path; and (i) a spring acting on said element guide for normally urging said element guide into an angular position to cause one of said guide legs to guide said rows of coupling elements in the guide groove therein while allowing the mounting slider to move past the other guide leg.

2. An apparatus according to claim 1, said idling roller having a member engagable with said element guide when said idling roller is displaced toward said driven roller, for angularly moving said element guide against the resiliency of said spring to cause the other guide leg to guide the rows of coupling elements through the guide groove therein while allowing the mounted slider to move past said one guide leg.

3. An apparatus according to claim 2, including a guide base disposed below said element guide and having a guide groove, said guide groove in said one guide leg and said guide groove in said guide base jointly defining a guide slot aligned with said feed path for guiding the rows of coupling elements therethrough when said element guide is in said angular position.

* * * * *